US009816167B2

(12) United States Patent
Kaptay et al.

(10) Patent No.: US 9,816,167 B2
(45) Date of Patent: Nov. 14, 2017

(54) METHOD AND APPARATUS FOR THE PRODUCTION OF CARBON FIBRE REINFORCED ALUMINUM MATRIX COMPOSITE WIRES

(71) Applicant: BAY ZOLTÁN ALKALMAZOTT KUTATÁSI KÖZHASZNÚ NONPROFIT KFT., LOGISZTIKAI ÉS GYÁRTÁSTECHNIKAI INTÉZET, Miskolc (HU)

(72) Inventors: György Kaptay, Miskolc (HU); Csaba Mekler, Miskolc (HU); Dávid Stomp, Csorna (HU); Péter Baumli, Miskolc (HU); István Budai, Debrecen-Józsa (HU); Koppány Levente Juhász, Miskolc (HU); Dávid Szabó, Miskolc (HU); József Szabó, Hajdúhadház (HU)

(73) Assignee: BAY ZOLTÁN ALKALMAZOTT KUTATÁSI KÖZHASZNÚ NONPROFIT KFT., LOGISZTIKAI ÉS GYÁRTÁSTECHNIKAI INTÉZET, Miskolc (HU)

( * ) Notice: Subject to any disclaimer, the term of this patent is extended or adjusted under 35 U.S.C. 154(b) by 28 days.

(21) Appl. No.: 14/779,905

(22) PCT Filed: Mar. 24, 2014

(86) PCT No.: PCT/IB2014/060101

§ 371 (c)(1),
(2) Date: Sep. 24, 2015

(87) PCT Pub. No.: WO2014/155276

PCT Pub. Date: Oct. 2, 2014

(65) Prior Publication Data

US 2016/0060743 A1 Mar. 3, 2016

(30) Foreign Application Priority Data

Mar. 27, 2013 (HU) ..... 1300181

(51) Int. Cl.
*C23C 2/12* (2006.01)
*C23C 2/02* (2006.01)
(Continued)

(52) U.S. Cl.
CPC ..... *C23C 2/12* (2013.01); *C22C 47/02* (2013.01); *C22C 47/04* (2013.01); *C22C 47/08* (2013.01);
(Continued)

(58) Field of Classification Search
CPC .. C23C 2/02; C23C 2/003; C23C 2/12; C23C 2/38; C22C 47/02; C22C 47/04;
(Continued)

(56) References Cited

U.S. PATENT DOCUMENTS 5,049,419 A * 9/1991 Kyono ..... D01F 11/123 427/250

OTHER PUBLICATIONS

Chung, Deborah D. L., "Chapter 7: Metal-Matrix Composites" in Carbon Fiber Composites, 1994 Butterworth-Heinemann, pp. 135-138.*

(Continued)

*Primary Examiner* — William Phillip Fletcher, III
(74) *Attorney, Agent, or Firm* — Jason D. Voight

(57) ABSTRACT

The invention relates to a method for the production of carbon fiber reinforced aluminum matrix composite wires by drawing carbon fibers through molten salt and molten aluminum in such a way that the molten aluminum and the molten salt are spatially separated, and the carbon fibers are drawn through first the molten salt, then the molten alumi- (Continued)

Figure 1:
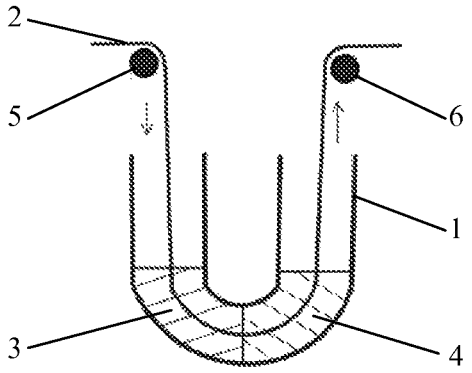

num separated from it. The invention further relates to an apparatus for the implementation of the method.

12 Claims, 1 Drawing Sheet

(51) Int. Cl.

| | |
|---|---|
| ***C22C 47/08*** | (2006.01) |
| ***C22C 49/06*** | (2006.01) |
| ***C22C 49/14*** | (2006.01) |
| ***C22C 49/11*** | (2006.01) |
| ***C22C 47/02*** | (2006.01) |
| ***C22C 47/04*** | (2006.01) |
| ***C23C 2/38*** | (2006.01) |
| ***C23C 2/00*** | (2006.01) |

(52) U.S. Cl.
CPC ..... *C22C 49/06* (2013.01); *C22C 49/11* (2013.01); *C22C 49/14* (2013.01); *C23C 2/003* (2013.01); *C23C 2/02* (2013.01); *C23C 2/38* (2013.01); *B22F 2999/00* (2013.01)

(58) Field of Classification Search
CPC ..... C22C 47/08; C22C 49/00; C22C 49/06; C22C 49/11
USPC ..... 427/404, 431, 434.2, 434.6; 118/419, 118/423
See application file for complete search history.

(56) References Cited

OTHER PUBLICATIONS

Baumli et al., "Fabrication of carbon fiber reinforced aluminum matrix composites via a titanium oxide-ion containing flux," Composites: Part A 44 (2013) 47-50, available online Sep. 7, 2012.*
Krendelsberger et al., "Texture Effects in TiB2 Coatings Electrodeposited from a NaCl—KCl—K2TiF6—NaF—NaBF4 Melt at 700° C.," Jounal of Mining and Metallurgy, 39 (1-2) B (2003) 269-274.*
Li et al., "Preparation of a titanium carbide coating on carbon fibre using a molten salt method," Carbon 46 (2008) 305-309.*
Li et al., "A convenient, general synthesis of carbide nanofibres via templated reactions on carbon nanotubes in molten salt media," Carbon 47 (2009) 201-208.*
Bauri, Ranjit, "Synthesis of Al—TiC in-situ composites: Effect of processing temperature and Ti:C ratio," Transactions of the Indian Institute of Metals, Oct. 2009, vol. 62, Issue 4-5, pp. 391-395.*
Juhasz et al.: "Fabrication of carbon fibre reinforced, aluminium matrix composite by potassium iodide (KI)—potassium hexafluorotitanate (K2TiF6) flux", Mat.-wiss. u. Werkstofftech., 2012, vol. 43, No. 4, pp. 310-314.
Baumli et al.: "Perfect wettability of carbon by liquid aluminum achieved by a multifunctional flux", J Mater Sci, 2010, vol. 45, No. 19, pp. 5177-5190.

* cited by examiner

METHOD AND APPARATUS FOR THE PRODUCTION OF CARBON FIBRE REINFORCED ALUMINUM MATRIX COMPOSITE WIRES

This is the national stage of International Application PCT/IB2014/060101, filed Mar. 24, 2014.

The invention relates to a method and apparatus for the production of carbon fibre reinforced aluminium matrix composite wires by a continuous production process.

Composite materials consist of at least two phases, typically a matrix and a second dispersed phase. Aluminium matrix composites are the most important family of metal matrix composites, mainly due to the low density, good corrosion resistance properties, as well as relatively high production volume and low price of Al. Aluminium matrix composites can be produced with several types of dispersed phases, one of them includes the various modifications of carbon (elemental carbon), these are uniformly marked as Al/C composites.

Each composite material is essentially characterized by the strength of the adhesion energy between the matrix and the dispersed phase. The stronger the adhesion between the two phases, the more successful the interaction of the two types of phases in the composite, and typically the better the properties of the composite. Where good adhesion is not easily achieved, a pressure difference is provided, typically by some mechanical means, to make up or compensate for that during the production of the composite. It is, however, necessary to point out that although the use of a pressure difference allows the forcing of the two phases together, that does not create a strong adhesion at the interface of the components of the composite, and the properties of the composite, despite the apparently successful production, will fall short of the expectations. Thus we should aim at producing a composite without the use of pressure. The properties of composite materials typically improve with a reduction in the size of the dispersed phase, thus in our case with a reduction in the diameter of the carbon fibres. However, with a reduction in size the methods using a high pressure difference for infiltrating the fibres of the carbon fibre bundle with molten metal (matrix material) are becoming less effective in a continuous process.

Composite production processes can be divided into two major groups: batch and continuous processes. A batch, or static process can be used to produce smaller products, in this case a preform determines the shape and size of the product. A continuous process can be used to produce wires, rod products made with long carbon fibres. Obviously, the continuous production method is economically substantially more advantageous than the batch production method.

Several methods are known in the literature for the production of carbon fibre reinforced aluminium matrix composites.

Rossi R. C. et al. [Ceramic Bulletin 50, 484-487 (1971)] produced a carbon fibre/Al composite by pressure infiltration. They called attention to the need to clean the surface of the carbon fibres.

In 1987 Goddard D. M. et al. [Engineered Materials Handbook 1, pp. 867-873 (1987)] summarized the state of the art. Technically, molten aluminium can infiltrate between carbon fibres only if the carbon fibres are $TiB_2$-coated by chemical vapour deposition (CVD). This method is obviously very costly, and narrows the market of the thus produced C/Al composites to the aerospace and space industry.

Kendall E. G. et al. [U.S. Pat. No. 4,082,864, (1984)] produced a long carbon fibre reinforced aluminium matrix wire by vapour deposition of a metal boride coating on the surface of the carbon fibres, and subsequently immersing the thus prepared carbon fibres in a molten bath of the metal matrix material.

Rohatgi P. K. et al. [Z. Metallkunde 82, 763-765 (1991)] coated the carbon fibres with copper before infiltration with molten Al.

Xia Z. et al. [Metall. Trans. B. 23B, 295-302 (1992)] produced composites by variable pressure infiltration. The carbon fibres were chemically coated with Ni.

Blucher J. T. et al. [Mater. Sci. Eng. A387-389, 867-872 (2004)] produced composites by drawing carbon fibres through molten aluminium under high pressure (30-80 bar). An $Al_4C_3$ phase was found at the Al/C interface, the volume of which could be reduced by reducing the contact time. Without surface treatment they could not produce C/Al composites in a reproducible manner.

Baumli P. [Composites A 44, 47-50 (2013)] examined the possibility of producing aluminium matrix composites by a static (batch) method using molten salt, by cutting the carbon fibres used as the reinforcement phase into short, 1 cm pieces, and placing on them aluminium pieces and the salt. During his experiments, by this method he succeeded in producing composite materials in small amounts of maximum 3-6 g per batch experiment. The key to success was the use of a salt containing $K_2TiF_6$, dissolved in molten alkali chloride and fluoride salts, probably creating a temporary TiC layer at the interface of the molten Al and the carbon fibre.

Juhasz K. L. [Mater.-wiss. Werkstofftech. 43, No. 4, 310-314 (2012)] developed further the static method of composite production by using potassium iodide (KI) as the main salt.

Orbulov I. N. et al. [Materials Science Forum 659 229-234. (2010)] produced carbon fibre reinforced aluminium matrix composite pipes by pressure infiltration technique. The test specimens made from the pipes containing about 60 vol % carbon fibre showed high specific strength.

A common element of the prior art methods is that the results were achieved in each case using a batch (non-continuous) process, in some cases under high pressure.

The aim of the invention is to develop a method that allows the economic production of long carbon fibre reinforced aluminium matrix composite wires by a continuous production process, without the use of a pressure difference and stirring.

The invention is based on the recognition that if the molten salt is spatially separated from the molten aluminium and the carbon fibre bundle is drawn through the thus separated melts, first the molten salt, then the molten aluminium, first the molten salt and then the molten aluminium flows between the carbon fibres under normal pressure, filling the gaps between the fibres perfectly. In the thus produced composite the adhesion between the matrix material and the surface of the reinforcement phase will be the strongest possible, ensuring the theoretically best achievable properties.

Thus the invention relates to a method suitable for the production of carbon fibre reinforced aluminium matrix composite wires, and an apparatus for the implementation of the method.

The method according to the invention allows the production of long carbon fibre reinforced aluminium matrix composite wires by a continuous production process at a temperature of 800±100° C., under normal pressure and in a normal atmosphere.

The molten salt used in the method is $K_2TiF_6$, dissolved in a molten alkali halide salt. Preferably NaCl and KCl in an equimolar amount is used as the alkali halide salt, containing 10-20 wt % of $K_2TiF_6$.

The method can be implemented under atmospheric pressure in an air or inert gas atmosphere. Optionally, the method can be implemented under vacuum as well, or at any pressure and temperature between the melting point and the boiling point of the salt mixture and metal used.

Figure 2:
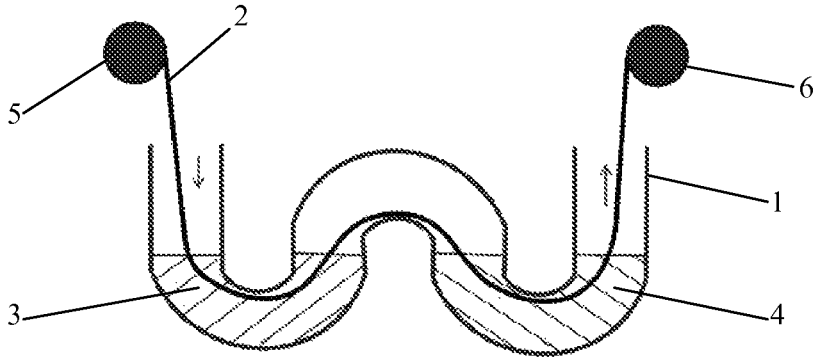

Our method is described in more detail with reference to the following drawings:

FIG. 1: A schematic drawing of the experimental setup where the molten salt and the molten aluminium are not spatially separated from each other in a single U-tube FIG. 2: A schematic drawing of the laboratory setup where the molten salt and the molten aluminium are spatially separated from each other in a double U-tube FIG. 3: A schematic drawing of the apparatus suitable for continuous industrial production For the laboratory implementation of the method a specially designed double U-tube shown in FIG. 2 was used.

The use of that U-tube 1 in the method allows the spatial separation of the molten salt 3 from the molten aluminium 4, ensuring thereby that only the necessary amount of molten salt 3 gets into the molten aluminium 4, as much as can penetrate between the carbon fibres 2 and can stay there firmly until the carbon fibre bundle passes from the molten salt to the molten metal.

However, we found that when the experimental setup shown in FIG. 1 was used, which is a single U-tube 1 and in which the molten salt 3 and the molten aluminium 4 are not spatially separated from each other, that is they have a common interface, we could not produce a composite wire by a continuous process.

In the method the carbon fibre 2 bundle is wound on a supply reel 5, then led through the U-tube 1, and the end of the bundle is connected to a take-up reel 6. The U-tube 1 with the carbon fibre bundle in it is placed into a furnace.

Preferably first the surface of the carbon fibres is subjected to a heat treatment in order to remove the coating (resin) from the surface. This is done by heating up the furnace during the experiment, and when the furnace reaches a certain temperature range (300-400° C.), the carbon fibre is wound from the supply reel 5 to the take-up reel 6 in such a way that the full length of the carbon fibre passes through the furnace (the tube) and the organic coating layer is burnt off. After winding it over, the operation is reversed so that the fibre bundle is wound back to the supply reel.

The furnace is heated up to the experimental temperature (800±100° C.). An argon atmosphere at 1 bar pressure, or an air atmosphere at 1 bar pressure is provided in the furnace. After reaching the target temperature, the system is maintained at this temperature for 10 minutes-1 hour in order to homogenize the temperature inside the chamber.

The salt mixture and the aluminium are placed in the U-tube 1 and melted in an argon atmosphere. The volumes of the molten salt 3 and the molten aluminium 4 are selected to be the same, thus the length of the carbon fibre 2 bundle will be the same (about 130 mm) both in the molten salt 3 and the molten aluminium 4, in the single U-tube 1 and the double U-tube 1 as well.

The carbon fibre 2 bundle is wound from the supply reel to the take-up reel, and thereby it is drawn through the molten salt 3 and the molten aluminium 4 in the U-tube 1. The maximum drawing/winding speed is 32 mm/s.

Importantly, the length of stay of the carbon fibre 2 bundle in the molten salt 3 and the molten aluminium 4 should not be less than a critical value. This critical value increases quadratically with the increase in the diameter of the carbon fibre bundle. For a carbon fibre bundle diameter of 2 mm the critical value is about 6 s.

Figure 3:
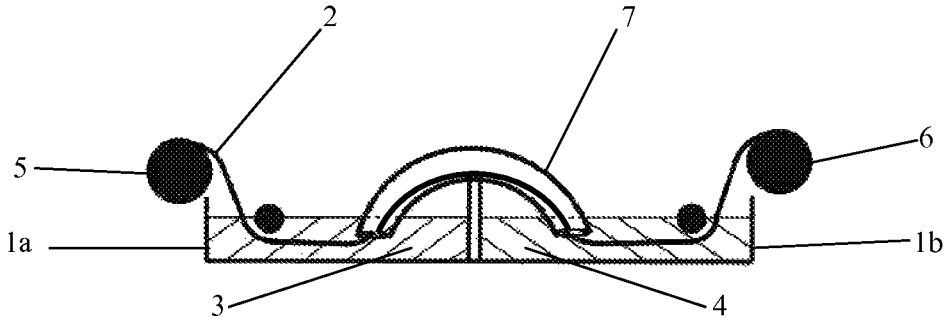

FIG. 3 shows a schematic drawing of the apparatus suitable for the implementation of continuous industrial production. The main parts of the apparatus are a heatable molten salt container 1*a* and molten aluminium container 1*b* for holding the molten salt 3 and the molten aluminium 4, respectively, and a supply reel 5 and a take-up reel 6 for moving the carbon fibres 2. The molten salt container 1*a* and the molten aluminium container 1*b* are spatially separated. Preferably they are connected by a ceramic tube 7 to protect the carbon fibres from oxidation, and to guide the carbon fibre 2 bundle.

Our method is detailed in the following examples.

In the examples carbon fibres of a diameter of 7 micrometers were used in tightly packed bundles of a diameter of 1-3 mm.

The U-tubes were made of 99.7% metallurgical grade aluminium-oxide ceramics. The composite wire samples were examined with a scanning electron microscope (SEM). The samples were cut transversely, embedded in synthetic resin, and ground and polished to obtain a cross-sectional grinding. The SEM apparatus was equipped with an energy dispersive (EDAX) detector, by means of which we could determine the element composition of the phases shown in different shades in the SEM images.

EXAMPLE 1

In this case we wanted to demonstrate that when the molten salt is not separated from the molten aluminium, that is the single U-tube shown in FIG. 1 is used for the production, then it is not possible to produce a composite with an appropriate microstructure. Other parameters of the experiment were: carbon fibre bundle diameter 2 mm; salt mixture NaCl—KCl (molar ratio of 1:1)+15% w/w $K_2TiF_6$; experimental temperature 850° C. The drawing speed was 8 mm/s, that is the length of stay both in the molten salt and in the molten aluminium was 130 mm/8 mm/s=16 s. The SEM image of the composite wire showed that the carbon fibres were not surrounded by the molten aluminium, thus a carbon fibre reinforced aluminium matrix composite with an appropriate microstructure was not produced.

EXAMPLE 2

In this case we wanted to demonstrate that when the molten salt is spatially separated from the molten aluminium (the setup in FIG. 2), and the carbon fibre bundle is drawn through the molten salt and then the molten aluminium at a low speed, a drawing speed of 8 mm/s, then it is possible to produce a composite with an appropriate microstructure. Other parameters of the experiment were: carbon fibre bundle diameter 2 mm; salt mixture NaCl—KCl (molar ratio of 1:1)+15% w/w $K_2TiF_6$; experimental temperature 850° C. The drawing speed was 8 mm/s, that is the length of stay both in the molten salt and in the molten aluminium was 130 mm/8 mm/s=16 s. The parameters of Examples 1 and 2 are the same, the only difference is the use of a single U-tube (Example 1) or a double U-tube (Example 2). The SEM image of the composite wire showed that the space between the carbon fibres was completely filled by the aluminium, the surface of the carbon fibres was wetted by the molten aluminium, thus a composite with a perfect microstructure was produced.

EXAMPLE 3

In this case we wanted to demonstrate that when the molten salt is spatially separated from the molten aluminium, and the carbon fibre bundle is drawn through the molten salt and then the molten aluminium at a medium speed, a drawing speed of 16 mm/s, then it is possible to produce a composite with an appropriate microstructure. Other parameters of the experiment were: carbon fibre bundle diameter 2 mm; salt mixture NaCl—KCl (molar ratio of 1:1)+15% w/w $K_2TiF_6$; experimental temperature 850° C. The parameters of Examples 2 and 3 differ only in the drawing speed (length of stay). In Example 3 the drawing speed was 16 mm/s, that is the length of stay both in the molten salt and in the molten aluminium was 130 mm/16 mm/s=8 s. The SEM image of the composite wire showed that the space between the carbon fibres was completely filled by the aluminium, thus a composite with a perfect microstructure was produced.

EXAMPLE 4

In this case we wanted to demonstrate that when the molten salt is spatially separated from the molten aluminium, but the carbon fibre bundle is drawn through the molten salt and then the molten aluminium at a high speed, a drawing speed of 32 mm/s, then it is only partially possible to produce a composite with an appropriate microstructure. Other parameters of the experiment were: carbon fibre bundle diameter 2 mm; salt mixture NaCl—KCl (molar ratio of 1:1)+15% w/w $K_2TiF_6$; salt/Al weight ratio=1; experimental temperature 850° C. The parameters of Examples 2, 3 and 4 differ only in the drawing speed (length of stay). The drawing speed was 32 mm/s, that is the length of stay both in the molten salt and in the molten aluminium was 130 mm/32 mm/s=4 s. The SEM image of the composite wire showed that most of the carbon fibres were not surrounded by the molten aluminium, thus a carbon fibre reinforced aluminium matrix composite with an appropriate microstructure was not produced in the whole volume, the production of a composite was only partially successful, which was due to the too high drawing speed, or too short length of stay.

The advantage of the method is that it is suitable for the production of porosity-free long-fibre carbon fibre reinforced aluminium matrix composite wires by a continuous production process at atmospheric pressure. The method is reproducible, and provides a product of reliable quality with excellent mechanical properties.

The invention claimed is:

1. A method for the production of carbon fibre reinforced aluminium matrix composite wires by drawing carbon fibres (2) through molten salt (3) and molten aluminium (4), wherein the molten aluminium (4) and the molten salt (3) are spatially separated, and the carbon fibres (2) are drawn through first the molten salt (3), then directly the molten aluminium (4) separated from it.

2. The method according to claim 1, wherein the carbon fibres are drawn through the molten salt and the molten aluminium at a temperature between 700-900° C.

3. The method according to claim 2, wherein the carbon fibres are drawn through the molten salt and the molten aluminium in an air atmosphere at 1 bar pressure.

4. The method according to claim 1, characterized in that the molten salt (3) is $K_2TiF_6$, dissolved in a molten alkali halide.

5. The method according to claim 4, wherein the molten salt (3) is a molten equimolar mixture of NaCl and KCl, containing 10-20 wt % of $K_2TiF_6$.

6. The method according to claim 1, wherein the carbon fibres are drawn through the molten salt and the molten aluminium in an air atmosphere at 1 bar pressure or an inert gas atmosphere at 1 bar pressure.

7. The method according to claim 1, characterized in that the length of stay of the carbon fibres (2) in the molten salt (3) and the molten aluminium (4) is equal to or exceeds a critical value increasing quadratically with the increase in the diameter of the carbon fibre (2) bundle.

8. The method according to claim 7, characterized in that for a carbon fibre (2) bundle diameter of 2 mm the critical length of stay is about 6 s.

9. The method according to claim 1, wherein the carbon fibres are drawn through the molten salt and the molten aluminium within a single furnace.

10. An apparatus for the production of carbon fiber reinforced aluminum matrix composite wires, comprising heatable containers for holding a molten salt (3) and a molten aluminum (4); and a supply reel (5) and a take-up reel (6) for moving the carbon fibers (2), characterized in that the molten salt container (1*a*) and the molten aluminum container (1*b*) are spatially separated, and connected by a tube (7) to guide the carbon fiber (2).

11. The apparatus according to claim 10, wherein the tube (7) is a ceramic tube.

12. A method for the production of carbon fibre reinforced aluminium matrix composite wires, said method comprising continuously and simultaneously drawing a bundle of the carbon fibers through molten salt and molten aluminium, wherein the molten salt and the molten aluminum are in such an arrangement that a given point on the bundle passes first through the molten salt then through the molten aluminum, all within a single furnace, and wherein the molten aluminum and the molten salt are spatially separated.

* * * * *